US007631942B2

(12) United States Patent
Bechem et al.

(10) Patent No.: US 7,631,942 B2
(45) Date of Patent: Dec. 15, 2009

(54) DEVICE FOR MILLING ROCK AND OTHER MATERIALS AND METHOD FOR MILLING ROCK OR THE LIKE USING SAID DEVICE

(75) Inventors: Ulrich Bechem, Iserlohn (DE); Jens Steinberg, Hattingen (DE); Joachim Raschka, Bochum (DE)

(73) Assignee: DBT GmbH, Lunen (DE)

( * ) Notice: Subject to any disclaimer, the term of this patent is extended or adjusted under 35 U.S.C. 154(b) by 86 days.

(21) Appl. No.: 11/795,611

(22) PCT Filed: Jan. 26, 2006

(86) PCT No.: PCT/EP2006/000683

§ 371 (c)(1),
(2), (4) Date: Jul. 19, 2007

(87) PCT Pub. No.: WO2006/079536

PCT Pub. Date: Aug. 3, 2006

(65) Prior Publication Data

US 2008/0116734 A1 May 22, 2008

(30) Foreign Application Priority Data

Jan. 27, 2005 (DE) ..... 10 2005 003 840

(51) Int. Cl.
*E21C 25/10* (2006.01)

(52) U.S. Cl. ..... 299/85.1

(58) Field of Classification Search ..... 299/85.1
See application file for complete search history.

(56) References Cited

U.S. PATENT DOCUMENTS

| | | | | | |
|---|---|---|---|---|---|
| 3,412,816 | A * | 11/1968 | Lautsch | 175/106 |
| 4,436,345 | A * | 3/1984 | Silks et al. | 299/59 |
| 4,548,443 | A * | 10/1985 | Turner | 299/31 |
| 4,627,501 | A * | 12/1986 | Ebeling | 175/319 |
| 5,253,925 | A * | 10/1993 | Modzik, Jr. | 299/12 |
| 6,764,141 | B2 * | 7/2004 | O'Neill | 299/81.3 |

FOREIGN PATENT DOCUMENTS

| | | |
|---|---|---|
| DE | 34 45 492 | 8/1985 |
| GB | 2 018 861 | 10/1979 |

* cited by examiner

*Primary Examiner*—John Kreck
(74) *Attorney, Agent, or Firm*—Fay Sharpe LLP

(57) ABSTRACT

The invention relates to a device for milling rock or other materials. Said device comprises a spindle drum (13) which is rotatably mounted on a drum support (11) and in which a plurality of tool spindles (22) are received to be rotatable about spindle axes in a manner off-center of the drum axis (43). The tool spindles, at their ends projecting from the spindle drum, carry machining tools (41). The invention is characterized in that at least two of the tool spindles can be driven by a common gear drive which comprises output gears (24), permanently disposed on the tool spindles, and a common drive element (25) interacting with the output gears. The drive element and the spindle drum (13) can be rotated in relation to each other.

54 Claims, 12 Drawing Sheets

DEVICE FOR MILLING ROCK AND OTHER MATERIALS AND METHOD FOR MILLING ROCK OR THE LIKE USING SAID DEVICE

The invention relates to a device for milling treatment, in particular, rock or other materials, with a spindle drum which is rotatably mounted on a drum support about a drum axis, in which a plurality of tool spindles are supported eccentrically to the drum axis to be rotatably drivable about spindle axes and carry machining tools at their ends projecting from the spindle drum. The invention further relates to a method for milling rock or the like using such a device.

For the milling of rock or other hard materials as for example of extraction products in underground or open-work mining, of tarmac or concrete components in road or structural engineering, a plurality of milling systems are known, which are mainly rotary driven drums or discs, at the circumference of which are mounted milling tools, for example round shaft bits, in an evenly distributed manner. If rock or coal is extracted in underground mining with such a drum provided with milling tools at its circumference, for example with the help of a drum shearer loader, and the cutting disk or drum cuts or mills the material to be extracted with a full face cut, approximately half of all machining tools arranged at the circumference of the drum are engaged simultaneously. Each machining tool is engaged with the material to be machined during the full face cut via half a rotation, that is 180°, which results in that the hard metal tips of the tools are heated to very high temperatures and wear quickly, especially in harder materials.

A further disadvantage with the known machines consists in that the entire contact pressure, with which the drum abuts against the rock, is distributed onto a large number of individual tools, so that for every individual chisel in use, only a comparatively small pressure force is available. If the entire pressure of the drum against the rock is for example about 2000 N, and about 20 individual tools are always used during a full cut, on the average every individual tool has only a contact pressure of 100 N. Furthermore, it is also difficult to axially drive into the material to be machined with the known devices, in which the tools are drivingly connected at the circumference of a roller or a drum, which problem can be attributed to the fact that the optimum cutting speed is at the outer diameter of the drums, and that the cutting speed is consistently reduced in the direction towards the axis of rotation of the drum or the roller, and becomes so small in the proximity of the axis of rotation, that cutting is practically impossible there. Even when the drum is provided with tools at its face side, these cannot break out the rock abutting their face during the axial driving-in of the drum in a reasonable manner.

From DE 34 45 492 C2, a boring head for boring in rock is known, which comprises a tool support with boring tools, which is mounted on a central shaft, which is coupled to bore rods extending between the bore hole and the boring head. The boring tools at the tool support can be rotatably driven via a planetary gear transmission.

It is the object of the invention to create a device for the milling treatment of rock or other materials of the above-mentioned type, which is able to also treat very hard materials with a high milling performance, whereas, compared to conventionally driven tools, the pressing forces exerted by the spindle drum are reduced and the edge lives of the tools are extended. Particularly, the device according to invention shall have a high operational security, be compact and offer the possibility to receive machining tools of different types as for example milling rollers, saw blades, undercutting tools or the like with arbitrary weights and sizes.

This object is being solved with the invention with the features as defined in the independent claims. As at least two of the tool spindles can be driven by a common transmission gear drive, which comprises driven gear wheels drivingly connected to the tool spindles and a common drive element, in particular a drive gear wheel or also a drive chain, a drive transmission belt or the like, which drive element cooperates with the driven gear wheels, while the drive element and the spindle drum can be rotated relatively to one another, a particularly compact arrangement of a device is created, in which the at least two tool spindles with the tools thereon are driven synchronously outside the centre axis of the spindle drum. The machining tools arranged at the tool spindles can thereby be adjusted easily so that even during a full cut with an abutment of 180° respectively only one machining tool or only a few tools are used simultaneously, so that the entire available pressing force of the spindle drum can respectively only be used by one or a few tools, that is, the individual tool presently in engagement with the rock has a very high loosening force.

It is possible that the spindle drum comprises a rotary drive, which is decoupled from the transmission gear drive. In this embodiment, the spindle drum is thus rotated by a rotary drive and the tool spindles experience their drive independently of the rotary speed of the spindle drum. With this embodiment, it is even feasible to stop the spindle drum in any case briefly during the axial drive-in of the device into the rock and to bore a short distance into the rock only by rotation of the tool spindles, and only then to start the drive for the spindle drum.

It has proved to be particularly advantageous if the spindle drum and at least some of the tool spindles have a common rotary drive, so that, with a rotation of the spindle drum, the tool spindles which are also acted upon by the common rotary drive are also automatically rotated.

In this context, it is constructionally advantageous if the drive element formed from a drive gear wheel is arranged irrotationally with respect to the drum support, in particular firmly connected to the drum support. The driven gear wheels drivingly connected to the tool spindles then mesh with the drive gear wheel arranged irrotationally with respect to the drum support, whereby the tool spindles are rotated when the spindle drum in which the tool spindles are received is driven by the rotary drive. Very high forces and torques can be transferred with such a planetary gear drive with a particularly compact design.

The tool spindles are preferably received in bearing bushes by means of bearings in a rotary manner and are conveniently sealed by shaft seals. It is particularly advantageous with such an arrangement, if the bearing bushes with the tool spindles mounted therein in a rotary manner are inserted and locked in an exchangeable manner like cartridges in drum chambers provided at the spindle drum. The tool spindles can then be replaced with their bearings and possibly seals by simple exchange of the bearing bushes in the structural unit, for example when they are worn or when tool spindles for other machining tools are to be used. The tool spindles in the bearing bushes are pre-mounted, so that removal and fitting of this structural unit only takes a very short time.

Preferably, all tool spindles can be drivable via the common drive gear wheel of the transmission gear drive. However, it is also easily possible that a first group of tool spindles is drivable via a first common drive gear wheel and a second group of tool spindles is drivable via a second common drive gear wheel, for example in a case in which a first group of tool spindles is arranged at the spindle drum on a pitch circle having a larger diameter and a second group of tool spindles is arranged on a pitch circle having a smaller diameter. The gear transmission ratios between the tool spindles of the first group and the first drive gear wheel and the tool spindles of the second group and the second drive gear wheel and/or the directions of rotation of the tool spindles of the first and second group can then be different. As already suggested above, the tool spindles of the first group and those of the second group can be arranged with a different radial distance from the drum axis in the spindle drum, that is, on two different pitch circles.

The tool spindles are preferably arranged uniformly distributed over the circumference in the spindle drum.

In a particularly advantageous embodiment of the device according to invention it is possible that the machining tool(s) of one tool spindle is/are arranged in an offset manner relative to the arrangement of the machining tool(s) of the tool spindle being arranged in front or behind that one tool spindle in the drum circumference direction. In other words, the machining tools of tool spindles following each other in the circumferential direction of the spindle drum can be arranged with regard to one another in a phase-shift manner. This arrangement makes it possible to ensure in a particularly advantageous manner during the execution of the method according to the invention for milling of rock, that an individual tool arranged at a tool spindle reaches engagement with the rock to be machined at another point than an individual tool of a tool spindle lying in front of it in the direction of rotation. It is thus ensured by the phase-shifted arrangement of the tools that the impact points of the individual tools or cutters of the different tool spindles do not overlap, but that a following tool machines the rock at a point which the tools of a tool spindle moved previously through the rock have left. Thereby a particularly effective treatment of the rock or the like is achieved. In order to achieve the desired phase shift or the offset angle as exactly as possible, the machining tools are preferably arranged in an adjustable manner at the tool spindles, that is, they can be adjusted in their angular position relative to the tool spindles.

The machining tools can comprise one or several machining bits or individual tools at every tool spindle. In a particularly advantageous embodiment of the invention, at least some of the individual tools can consist of straight shank bits, while in some cases, flat chisel tools or roller bits have proved themselves, in particular roller bits which are formed conically on one side. For many machining uses it has proved to be advantageous if the machining tools project at the most with 50% of their machining surfaces radially over the outer circumference, that is, that at the most half of the individual machining tools of a tool spindle are in simultaneous engagement with the rock or the like.

The spindle drum can be provided with a preferably centrically arranged dust extraction opening, through which the fine dust which results during the milling treatment of the rock or the like can be extracted. It is also advantageous, if the device is provided with at least one sprinkling device for the machining tools, with which on the one hand the resulting dust can be bound by water sprayed on the machining point, and on the other hand, a cooling of the machining tools can be provided. The sprinkling device is preferably arranged at the spindle drum and/or at the drum support.

With the device according to invention, machining tools of different types can be used. It is thus possible, when the machining tools of one or several of the tool spindles essentially consist of a chisel support and several round bits, flat bits and/or roller chisels arranged thereon, whereas the arrangement is in such a manner that the chisel/bit tools arranged at the chisel support machine the rock or other respectively machined material in an undercutting manner in one or more layers. The arrangement is preferably made in such a manner that a tool operating in several layers tapers in the direction of the rock to be machined, preferably in the form of steps. The machining tools can essentially also consist of milling rollers, which are arranged on one or several tool spindles. These milling rollers can be formed cylindrically or can taper conically or expand towards the rock to be machined.

If the drive element consists of a drive gear wheel geared on the outside, which is connected to the drum support, the direction of rotation of the tool spindles is the same as the one of the spindle drum. If the drive element consists of a drive gear wheel geared on the inside, the tool spindles driven from such a drive gear ring rotate in the opposite direction of the spindle drum.

In order to provide the rotary drive for the spindle drum independent from the transmission gear drive for the tool spindles, a constructional embodiment has proven to be advantageous, in which the spindle drum comprises a reception bore for a drive shaft running coaxially to the drum axis, which drive shaft is rotatably supported in the reception bore and is coupled to the drive element for the tool spindle. The drive shaft is thus mounted rotatably concentrically in the spindle drum, which is not only particularly compact, but which also ensures a high stability of the construction. The spindle drum can comprise a closed housing with an approximately cup-shaped drum base and a housing lid, so that the drive element, that is, in particular the drive gear wheel, is received in the inside of the drum base and is connected to the drive shaft and is covered by the housing lid.

The transmission drive for the tool spindles is preferably arranged in an encapsulated manner in the spindle drum. The machining tools with their respective tool spindles can be in an overhung position at the spindle and can project from the spindle drum at the face and/or at the circumference.

So as to favour the axial driving-in of the device into the rock, it has been proved to be advantageous if the spindle drum is, additionally to the tool spindles which are arranged distributed over its circumference, provided with milling tools with a core milling cutter arranged in the inside of the pitch circle described by the tool spindles, which core milling cutter is preferably arranged with a small eccentricity to the drum axis. With the help of the core milling cutter which is formed in a driveable manner, it can be ensured that the entire rock present in front of the face of the spindle drum will be milled during the axial feed motion of the device therein.

In order to ensure a particularly stable reception of the tool spindles, the machining tools with their respective tool spindles are preferably mounted at the spindle drum by means of a two-point bearing. A fixed floating bearing can be provided for this, alternatively, an engaged bearing, in particular in the X-arrangement can be used, for example by means of taper roller bearings or the like.

Especially in cases where machining tools with a comparatively large axial length are to be used, for example tools with long milling shanks, it is particularly advantageous if the spindle drum comprises an approximately plate-like bearing flange in the proximity of the drum support for the reception of the first bearings of the tool spindles and a support journal projecting concentrically to the drum axis, at which at least one support element for the reception of the second bearings of the tool spindles is arranged. The regions of the machining tools which machine the rock are then between the two bearings, so that a particularly sturdy support is achieved. With this embodiment of the invention it can further be convenient, that the support element or the support journal comprises a bearing journal arranged concentrically to the spindle drum axis for the additional support of the spindle drum. Thereby it is then possible to also mount the spindle drum itself by means of a two-point bearing, that is to additionally support it at the end which is turned away from the drum support, and therewith to avoid bending which can occur with long tools and an overhung bearing.

The support element can consist of a lid flange arranged at the face of the support journal, which flange is provided with bearing receptions for the second bearing. The machining tools are then covered by the lid flange at their face and machine the rock only with individual tools which are arranged at their circumference and which project radially between the plate-like bearing flange and the lid flange of the spindle drum therefrom. It is also possible that at least two support elements are provided, which are arranged at different distances from the bearing flange and which respectively receive the second bearings of different tool spindles. With this arrangement, the second bearings of the tool spindles then have a distance from the face (free) end of the machining tools, which can then also be in engagement with the rock with their faces.

So as to avoid damages of the device by overloading, it has proved to be convenient that the drive element is connected to the drum support via an overload clutch, which can for example be a spring-loaded friction clutch. The spring load acting on the clutch is preferably adjustable, so that the activation value at which the clutch is released and the drive element slips through at the drum support can be adjusted.

The spindle drum can, at its rear side, which is turned away from the machining tools, be provided with a demountable covering cap sealed with regard to the drum support by means of a shaft seal, which cap enables access to the transmission gear drive and other parts lying below, which have to be serviced or inspected occasionally.

Generally, the tool spindle axes in the spindle drum will be aligned parallel to the drum axis. It is however also possible to arrange the tool spindle axes in an inclined manner relative to the drum axis, whereby the milling result can be improved further with some rocks or materials to be machined. In a further embodiment of the invention, every machining tool preferably comprises several individual tools arranged evenly over the circumference of the machining tool, and is mounted to the associated tool spindle using a detent coupling, whereby the number of possible lock positions of the detent coupling is adapted to the number at the machining tool so that these are in the same relative position to the tool spindle in every locked position. The detent coupling responds when the machining tool is blocked by the rock which it engages, so that the associated tool spindle which carries this tool can rotate further to the next lock position, into which the machining tool then locks again and rotates further. The machining tool thereby locks again in such a position where its relative position to the machining tools of adjacent tool spindles remains the same, that is, the originally adjusted phase shift or the offset of the machining tools of successive tool spindles remains after the response of the detent coupling and locking of the tool.

The device according to invention and the method that can be effected thereby are particularly suitable for the removal of mineral extraction products as for example coal, ore rock or the like. The device can be used for this purpose as replacement for a well-known cutting head of a drum shearing machine or as cutting head of a selective cut or full cu heading machine. The device and the method can advantageously also be used for the machining of concreted or tarmacked surfaces or buildings, for example when milling tarmacked or concreted road surfaces, during demolition of concrete buildings or the like. It is often advantageous for the different applications if the device according to the invention is mounted to an adjustable arm and is engaged with this against the rock or the like to be machined. Use of the device according to the invention is also conceivable with small appliances, for example with hand-held plaster milling devices.

Further characteristics or advantages of the invention result from the following description and the drawings, where preferential embodiments of the invention are explained further with examples. It shows:

Figure 5:
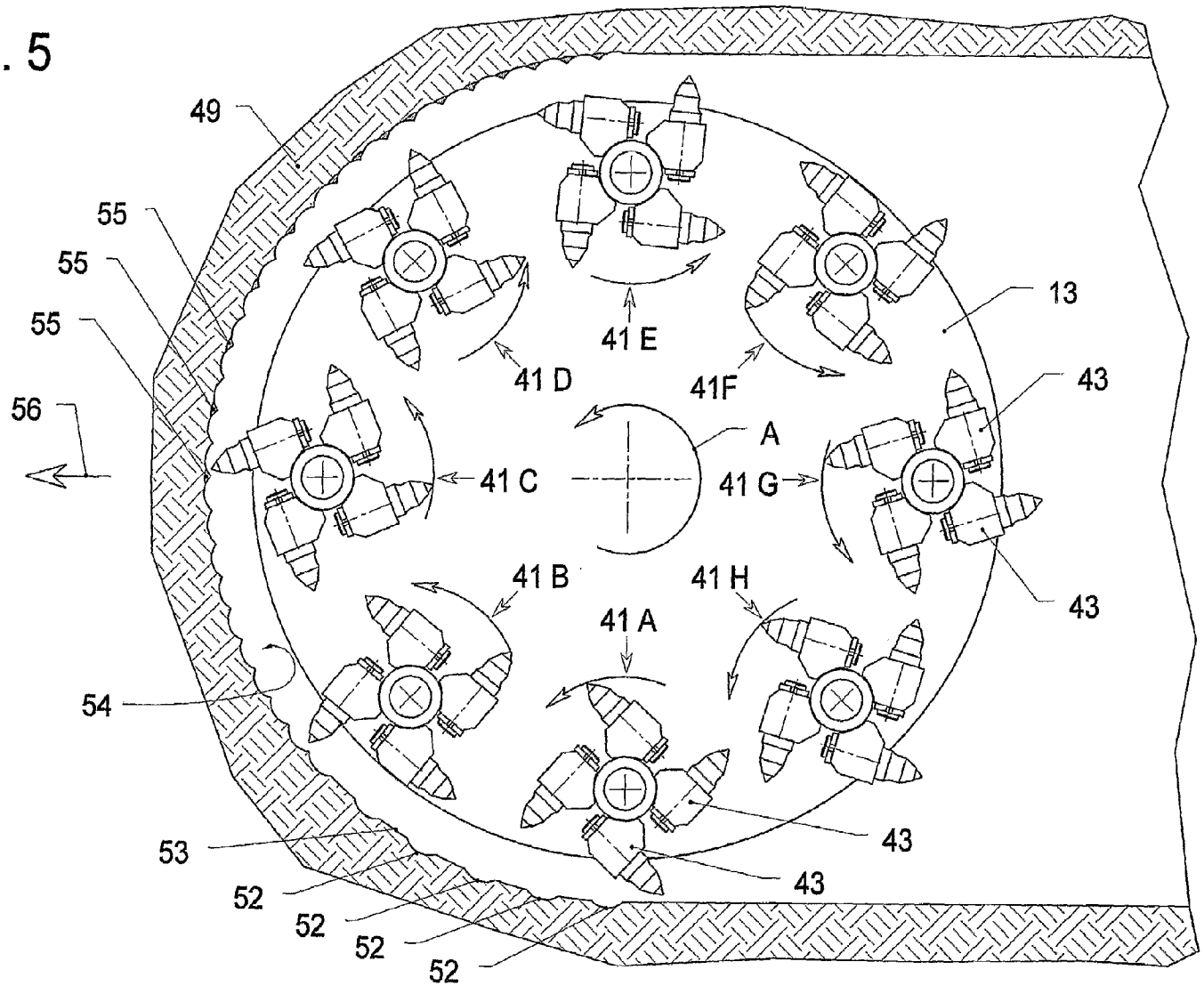
Figure 7:
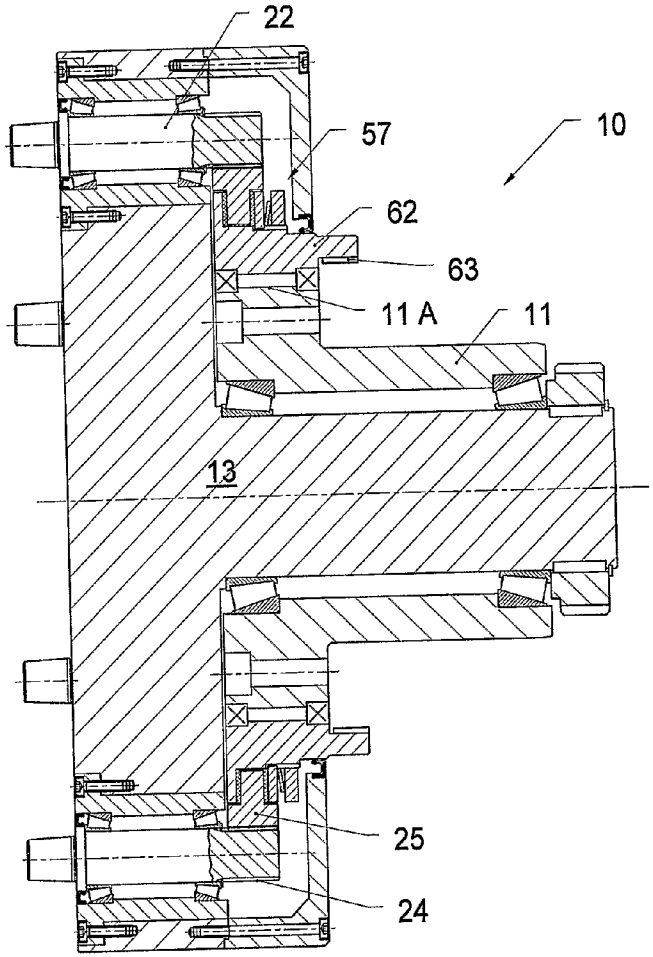
Figure 6:
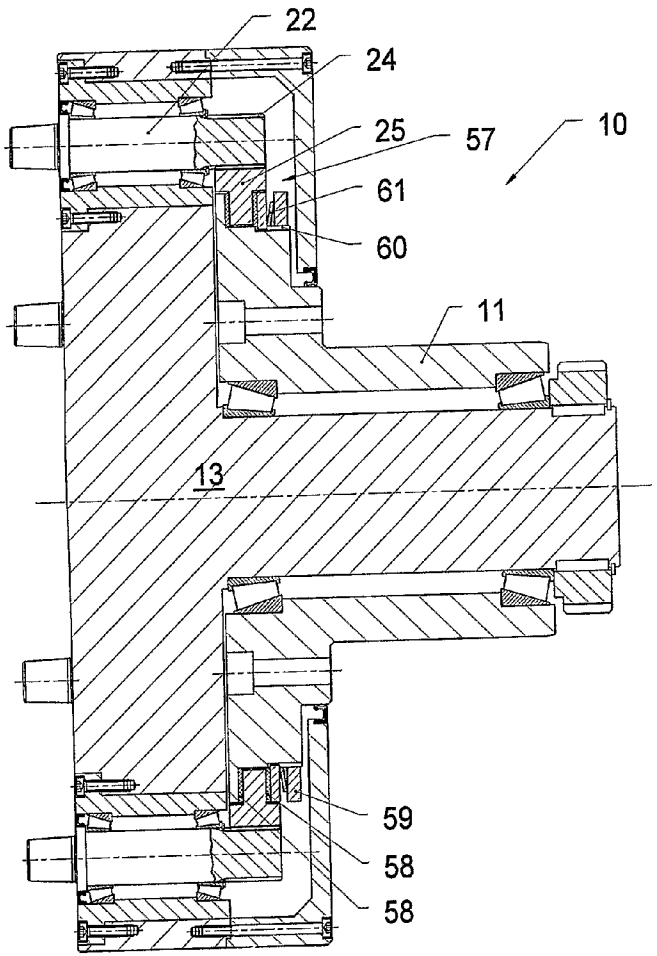
Figure 9:
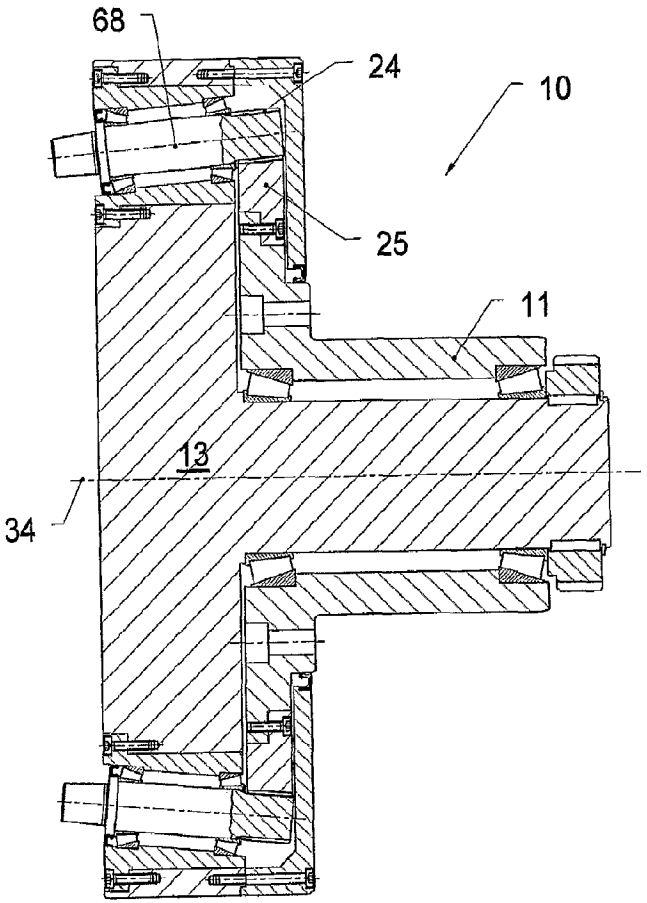
Figure 8:
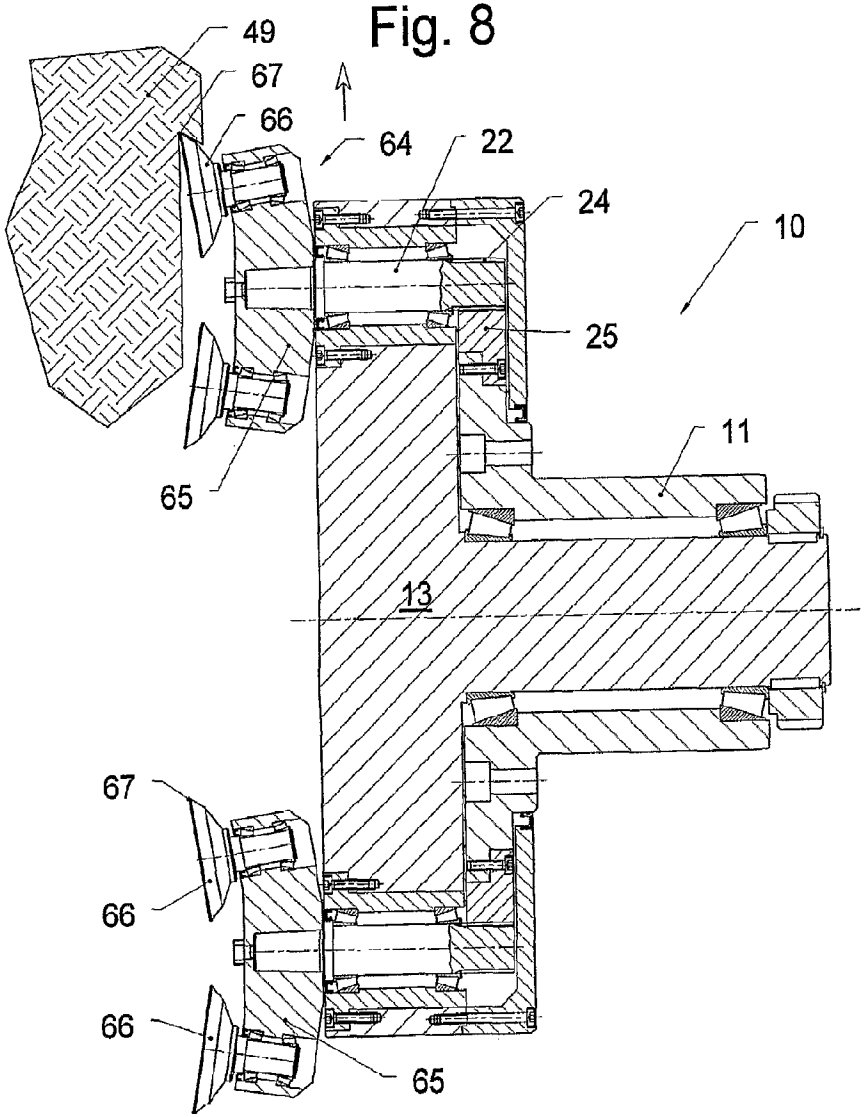
Figure 10B:
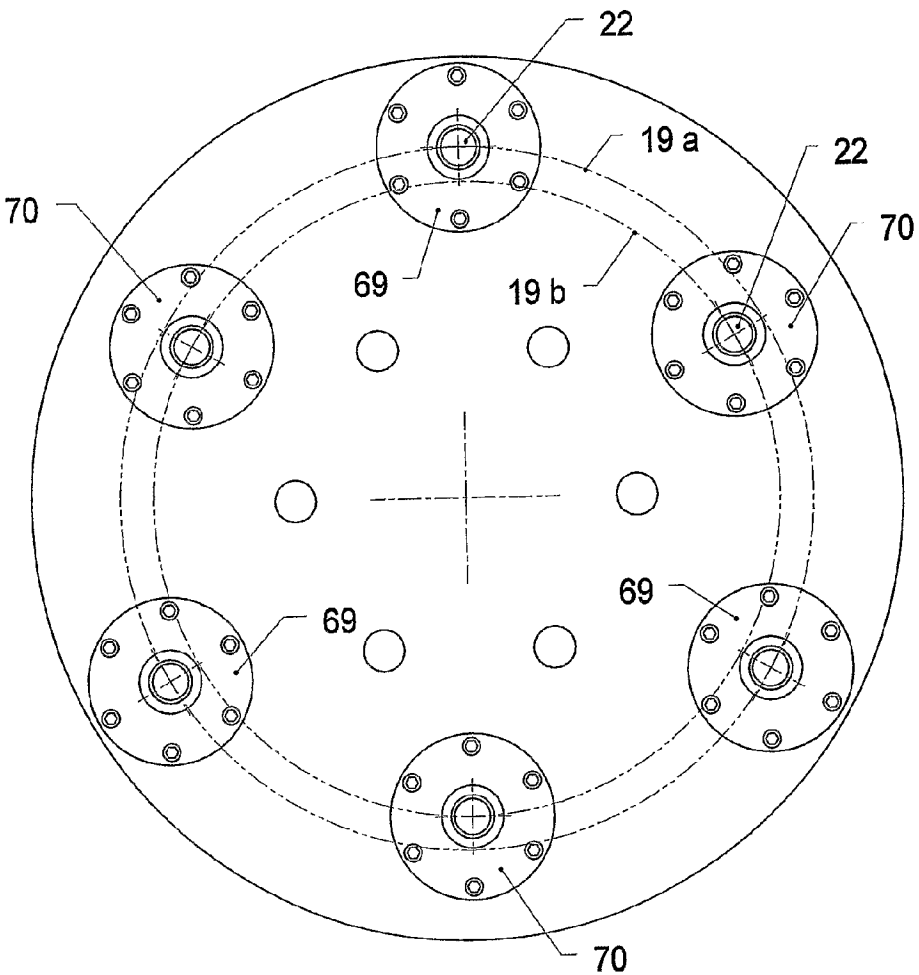
Figure 10A:
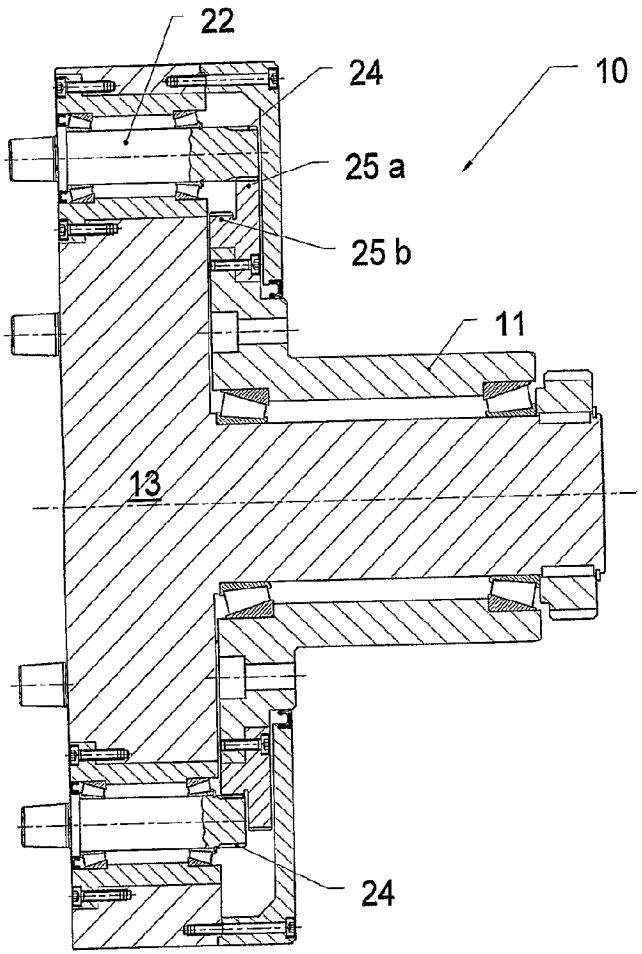
Figure 11:
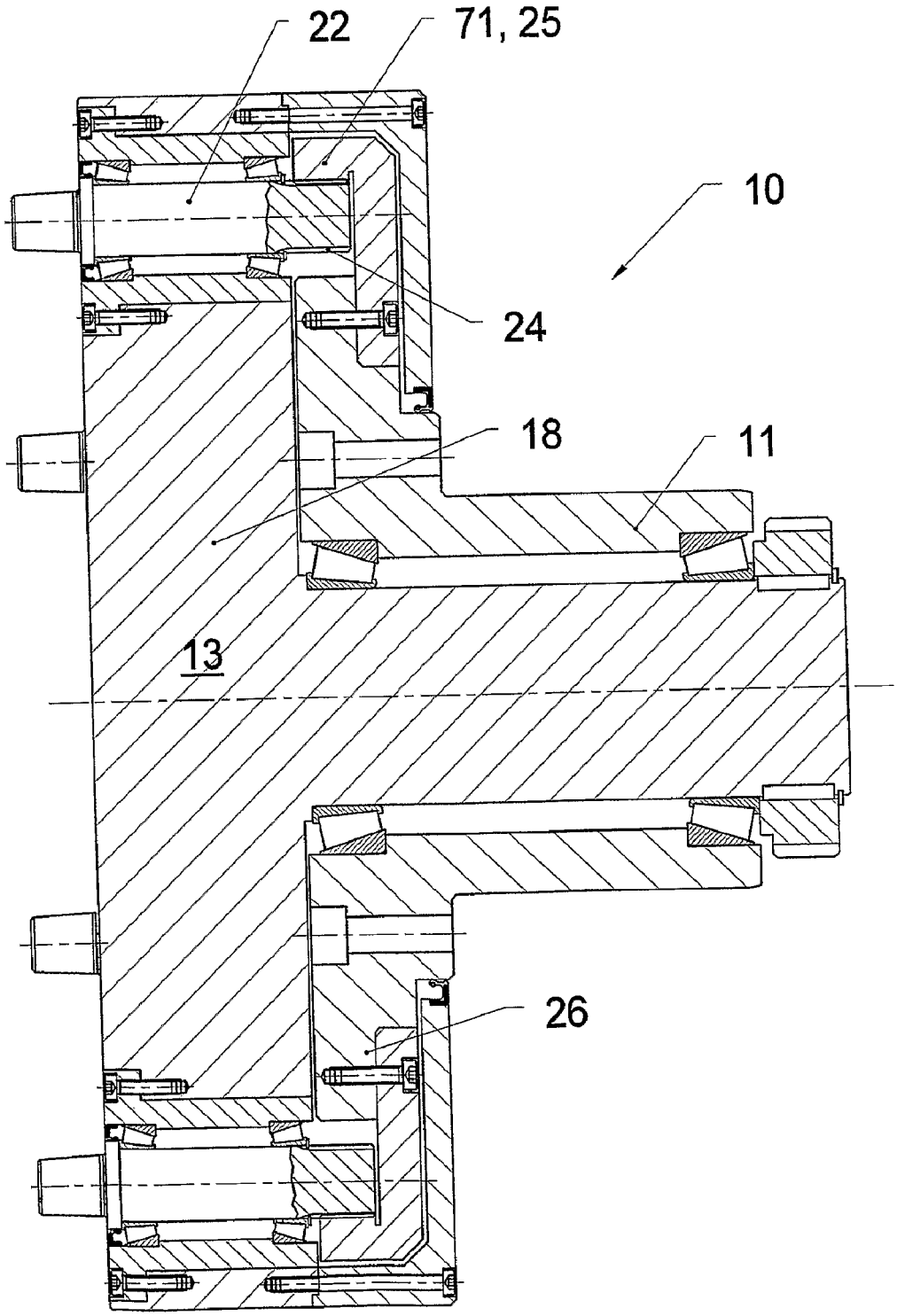
Figure 12B:
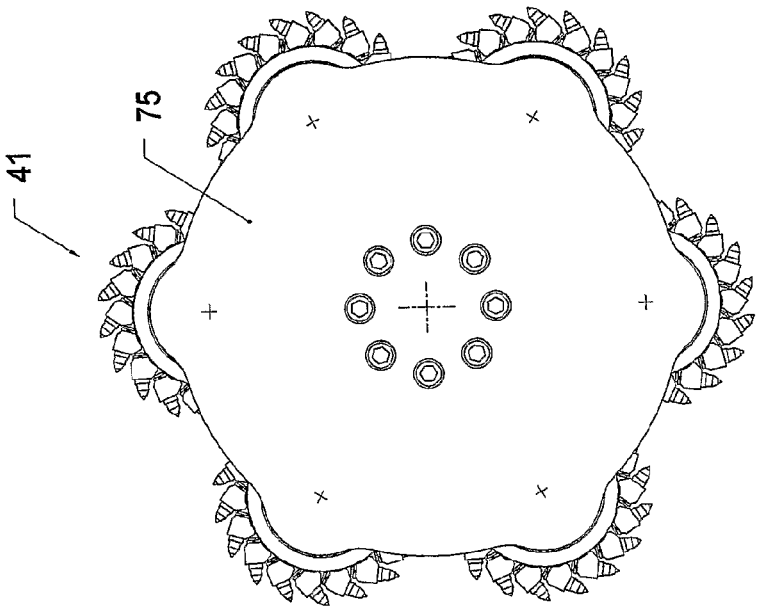
Figure 12A:
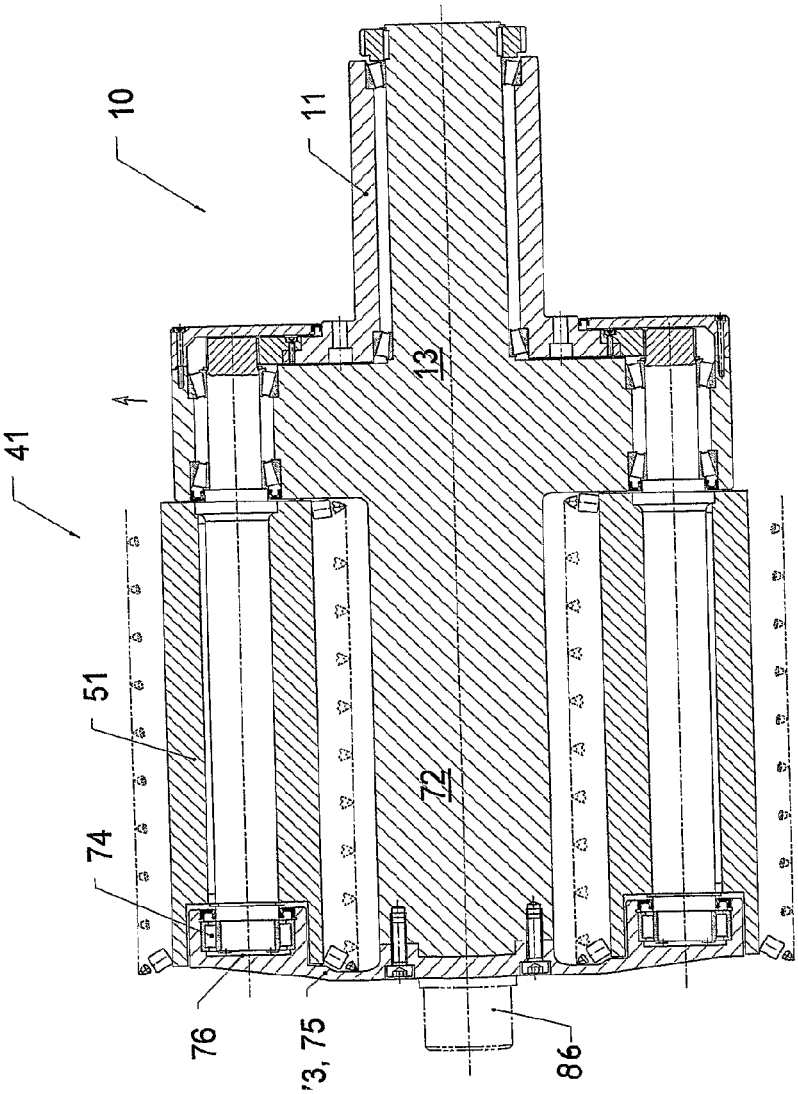
Figure 13B:
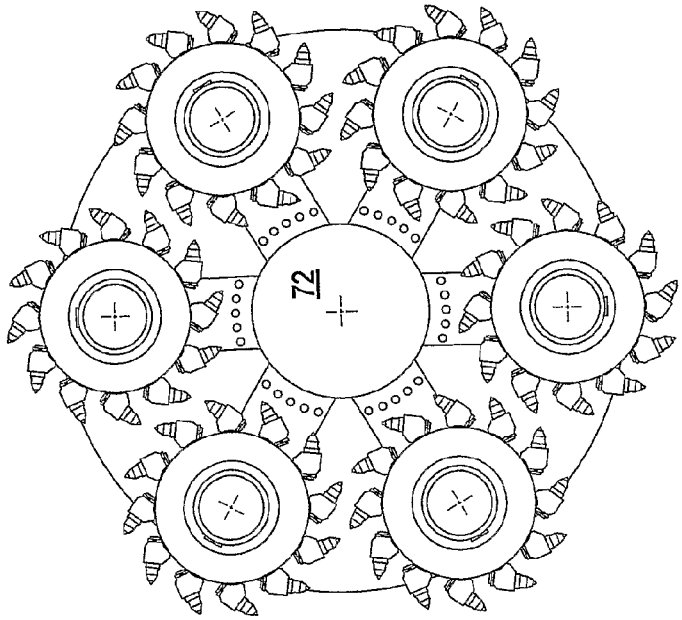
Figure 13A:
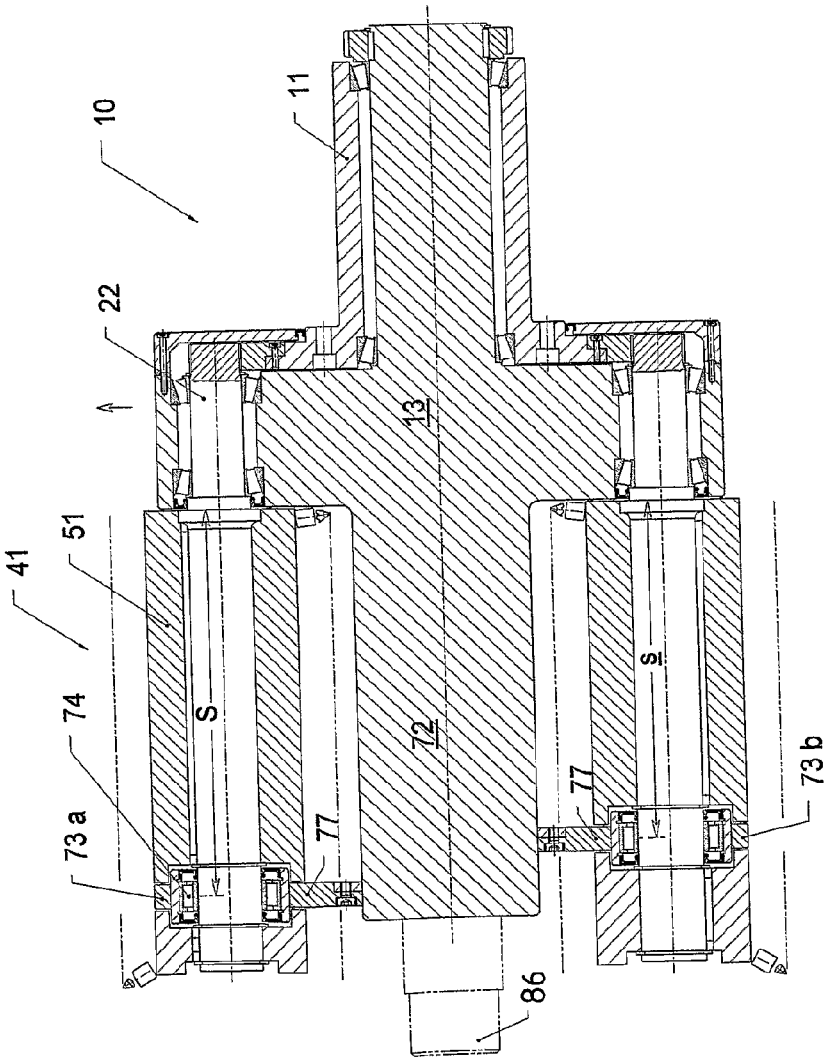
Figure 14B:
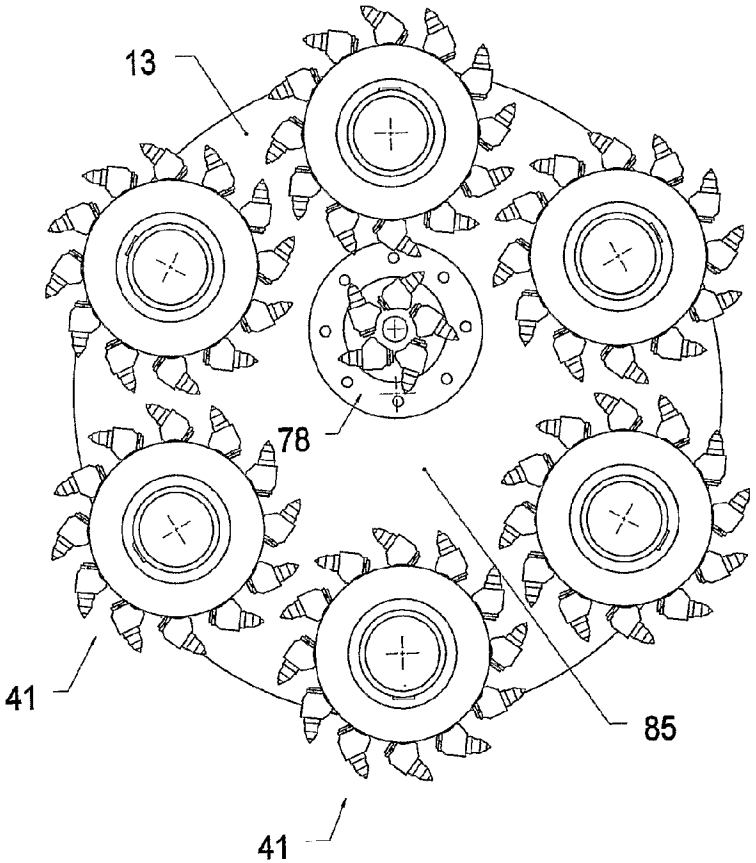
Figure 14A:
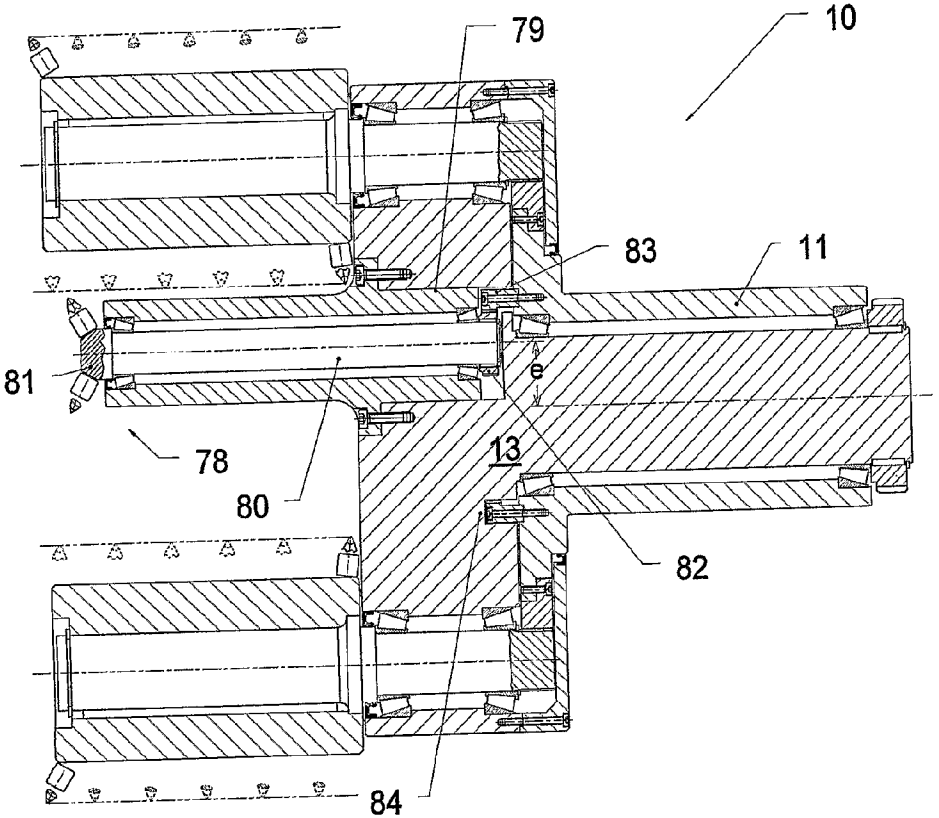

FIG. 5 a device according to invention during the implementation of the method according to the invention in contact with the rock in a view on the spindle drum and partially in cross section;

FIG. 6 a fifth embodiment of the device according to the invention in cross section;

FIG. 7 a sixth embodiment of the device according to the invention, also in cross section;

FIG. 8 a seventh embodiment of the device according to the invention;

FIG. 9 an eighth embodiment of the device according to the invention;

FIG. 10 (FIGS. 10A and 10B) shows a ninth embodiment of the device according to the invention in a representation corresponding to FIG. 1 to 4;

FIG. 11 a tenth embodiment of the device according to the invention in cross section;

FIG. 12 (FIGS. 12A and 12B) shows an eleventh embodiment of the device according to the invention in a representation corresponding to FIG. 1 to 4;

FIG. 13 (FIGS. 13A and 13B) shows a twelfth embodiment of the device according to the invention in a representation corresponding to FIG. 1 to 4; and FIG. 14 (FIGS. 14A and 14B) shows a thirteenth embodiment of the invention;

The various embodiments of the device according to the invention shown in the drawings, which device is designated as 10 in its entirety, serve for the milling of rock, for example mineral extraction products such as coal or ore, or also for the processing of concrete, tarmac or other building materials, for example during the milling of road surfaces or the like. As far as the different embodiments of the device according to the invention conform in their constructional details, a repeated description of these recurring details with different embodiments shall be forgone. Rather, after the detailed description of the fundamental construction on the basis of FIG. 1, essentially only the differences of the different embodiments will be explained.

Figure 1B:
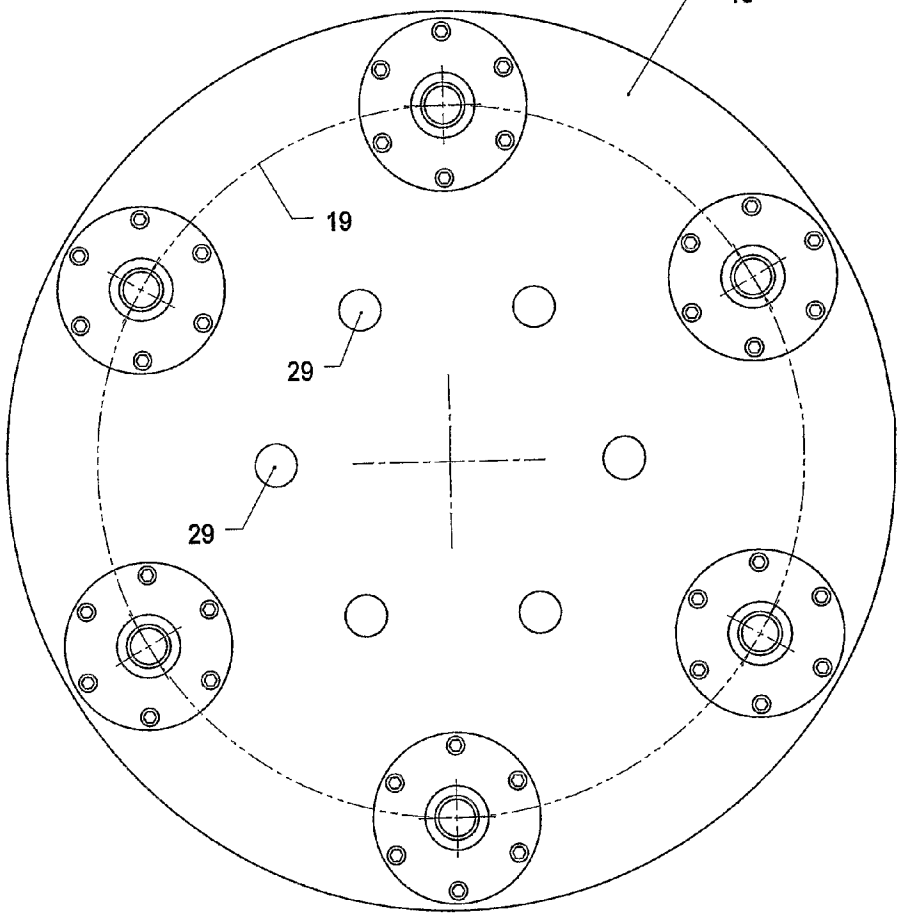
FIG. 1 (FIGS. 1A and 1B) shows a first embodiment of a device according to the invention in cross section (FIG. 1*a*) and plan view on the spindle drum.

Referring to FIG. 1, it can be seen that the device 10 according to the invention comprises a drum support 11 for the mounting to a machine body (not shown) suitable therefore, for example an extension arm of a winning machine or a road milling machine. The drum support 11 comprises a central bearing reception 12, in which a spindle drum 13 is pivoted by means of two taper roller bearings 15 adjusted in a back-to-back arrangement. The bearing journal 14 projects with its rear end 16 from the bearing reception 12 of the drum support 11 rearwardly and supports a drive wheel 17 there which is coupled to a rotary drive for the rotation of the spindle drum, not shown in detail.

The bearing journal 14 changes into a circular plate-like bearing flange 18 of the spindle drum at its other end opposite the drive wheel 17, which journal comprises several, in the example of the embodiment six, evenly distributed drum chambers 20 on a pitch circle 19 near its outer circumference. The drum chambers 20 each receive a bearing bush 21 with a tool spindle 22 mounted rotatably therein, whereby the bearing bushes with the tool spindles mounted therein like a cartridge are inserted into their respective drum chamber 20 in an exchangeable manner and are locked in the inserted state by means of fixing screws 23. At their rear end, with which the tool spindles project rearwardly from the bearing flange 18 of the spindle drum, they are provided with driven gear wheels 24 which mesh with a driving gear wheel 25, which is secured firmly to the drum support 11 with screws 27 at a gear wheel reception 26 provided for this. One can see in the first embodiment shown in FIG. 1, that the gearings of the driven gear wheels 24 of the tool spindles 22 roll off at the drive gear wheel 25 firmly mounted to the drum support 11, when the spindle drum 13 is rotated by the rotary drive effective at the drive wheel 17, so that the tool spindles are also rotated hereby. With this design, there exists a fixed gear transmission ratio between the rotatably driven spindle drum 13 and the tool spindles synchronously driven by the gear drive 24, 25 pivoted therein. With a gear transmission ratio of for example 10:1, the tool spindles rotate with 500 rpm when the spindle drum is driven with 50 rpm. The gear transmission ratio can be changed by a change of the diameters of the drive gear wheels and of the driven gear wheel or a change of the number of teeth. To this end, the drive gear wheel 25 can be disassembled and can be replaced by for example by a smaller gear wheel, while also other tool spindles with correspondingly larger drive gear wheels are inserted at the same time.

For the attachment of the entire device 10 to a machine frame (not shown) provided for this, as for example an arm of a drum shearing machine or a road milling machine, mounting holes 28 for fixing screws are provided at the drum support 11, which screws are threaded through access holes 29 provided in the bearing flange 18 of the spindle drum and can be screwed into threaded bores at the machine frame aligned with the mounting holes 28 by means of a suitable tool as for example an allen key. The entire device can be quickly installed at the machine frame without disassembly of any parts of the device.

Figure 1A:
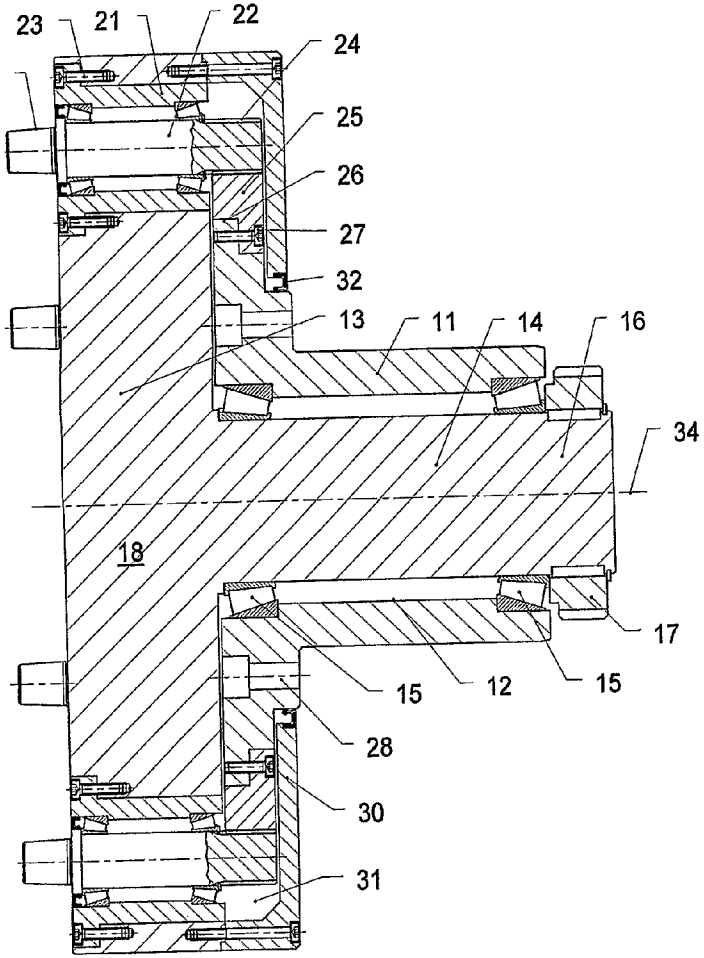

In FIG. 1A it can easily be seen that the bearing flange 18 of the spindle drum 13 is provided with a housing lid 30 at its rear side, which is screwed to the bearing flange 18 and together with this forms a closed housing 31 for the transmission gear drive 24, 25 of the tool spindles. In order to prevent an ingress of humidity or dirt into the housing 31, the housing lid 30 is provided with a seal 32 at its radial inner edge, with which the sealing with regard to the drum support is effected.

The front ends of the tool spindles projecting from the free side of the spindle drum form cone seat receptions 33 for machining tools, different designs of which being shown in FIG. 2 to 14. All these different designs of the machining tools can also be used with the embodiment of the design according to the invention according to FIG. 1, as will be described in detail in the following.

Figure 2B:
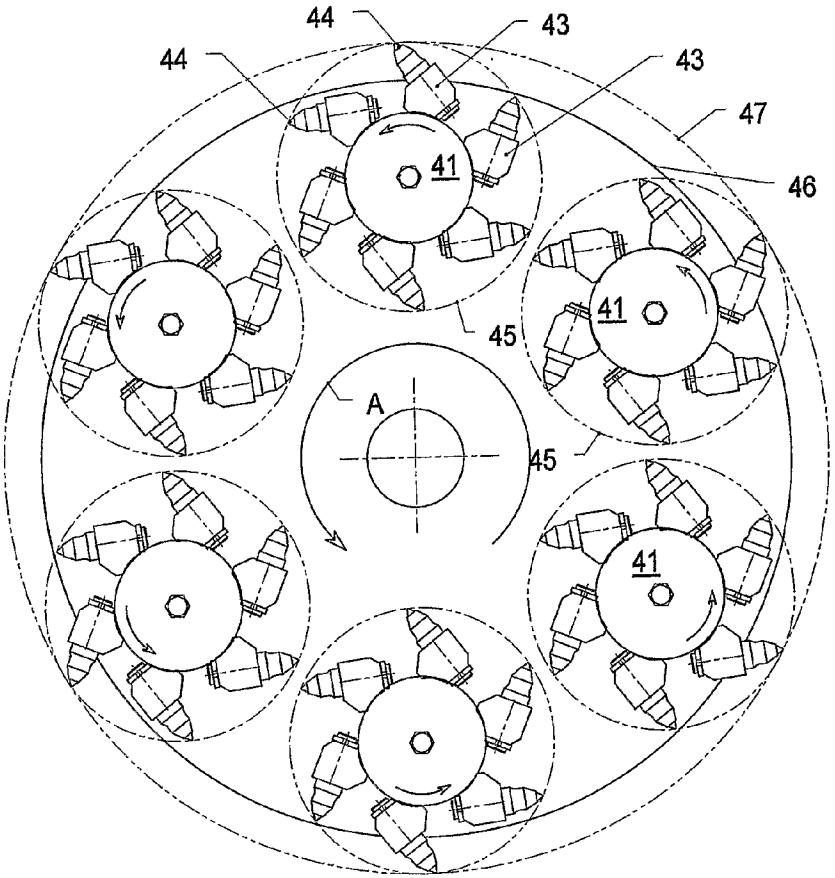
FIG. 2 (FIGS. 2A and 2B) shows a second embodiment of the device according to the invention in a representation corresponding to FIG. 1.
Figure 2A:
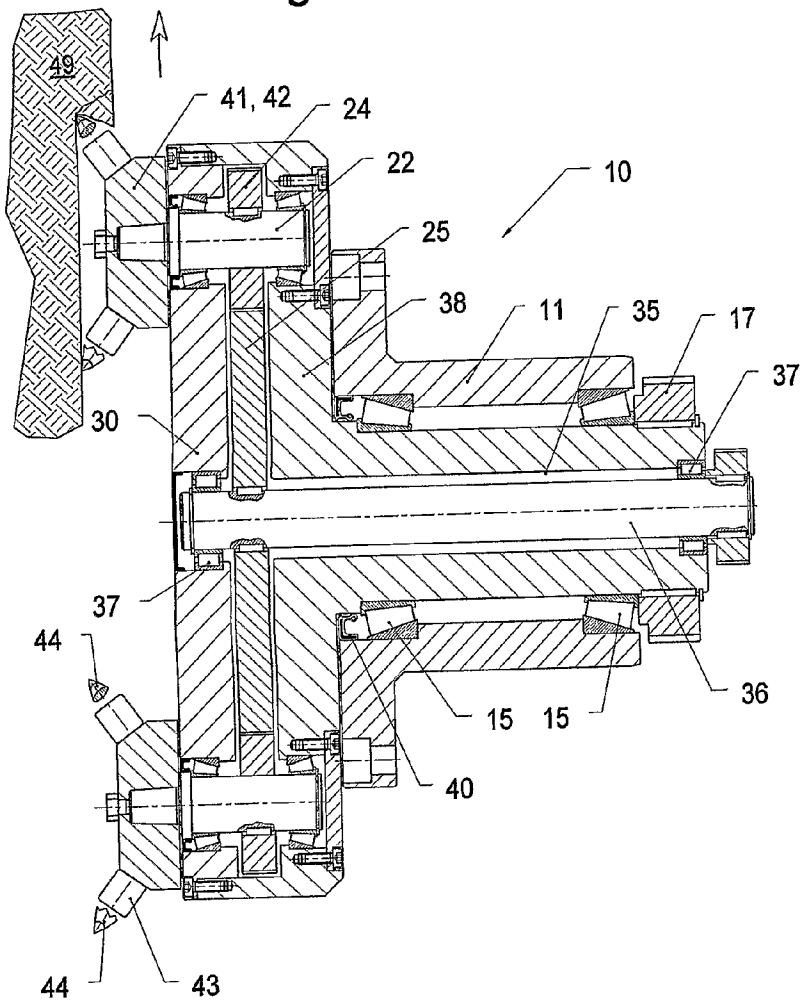

With the embodiment of the invention shown in FIG. 2, it is possible to adjust the number of revolutions and the direction of rotation of the individual tool spindles independently of the number of revolutions and the direction of rotation of the spindle drum. For this, the spindle drum 13 comprises a rotary drive, which is decoupled from the transmission gear drive of the tool spindles. This is solved constructionally in that the spindle drum 13 comprises a reception bore 35 for a drive shaft 36 running coaxially to the drum axis 34, which shaft is mounted in the reception bore in a rotary manner with two cylinder roller bearings 37. The front bearing flange 18 of the spindle drum forms a closed housing 31 with an approximately cup-shaped drum base 38 and a housing lid 30, and the drive gear wheel 25 of the transmission gear drive for the tool spindles is irrotationally mounted on the drive shaft 36 and is received in the housing 31 between the drum base 38 and the housing lid 30. There it meshes with the driven gear wheels 24 of the tool spindles 22.

The drive shaft is provided with a front gear wheel 39 at its rear end, which can be coupled to a spindle drive motor (not shown), so as to rotate the drive shaft 36 and thus the drive gear wheel 25 mounted thereon on the inside of the spindle drum and to hereby effect the rotary drive of the tool spindles, so that the number of revolutions of the tool spindles can be adjusted independently of the number of revolutions of the spindle drum.

In the embodiment according to FIG. 2, the tool spindles are not received in bearing bushes and inserted cartridge-like in drum chambers at the spindle drum, but the individual shafts are mounted directly in the spindle drum, whereas the rear of respectively two cone roller bearings is arranged in the drum base and the front bearing pointing to the machining side in the housing lid 30. The sealing of the spindle drum in relation to the drum support 11 is effected by means of a shaft seal ring 40 in this example of the embodiment, which is arranged in the transition region of the bearing flange 18 to the bearing journal 14.

With the example of an embodiment according to FIG. 2, chisel rings 42 with respectively six individual tools 43 in the form of impact chisels mounted thereon are used as machining tools 41, whereas the arrangement is such that the sphere of activity 45 defined by the impact tips 44 of the individual tools 43 projects with a relatively small segment over the outer circumference 46 of the spindle drum, so that, with the example of an embodiment shown, no more than two individual tools 43 project radially over the outer circumference 46 of the spindle drum at the same time. The circle line 4 describing the individual spheres of activity 45 of the six machining tools 41 defines the milling diameter of the device in the rock, that is, the range within which the machining tools machine the rock with their individual tools. It can be seen that no more than ⅓ of all individual tools are engaged at the milling line 47 in the rock at a respective time, that is, every tool only breaks out rock on ⅓ of the path covered by a rotation of the tool spindle and is subjected to the loads created thereby.

Figure 3B:
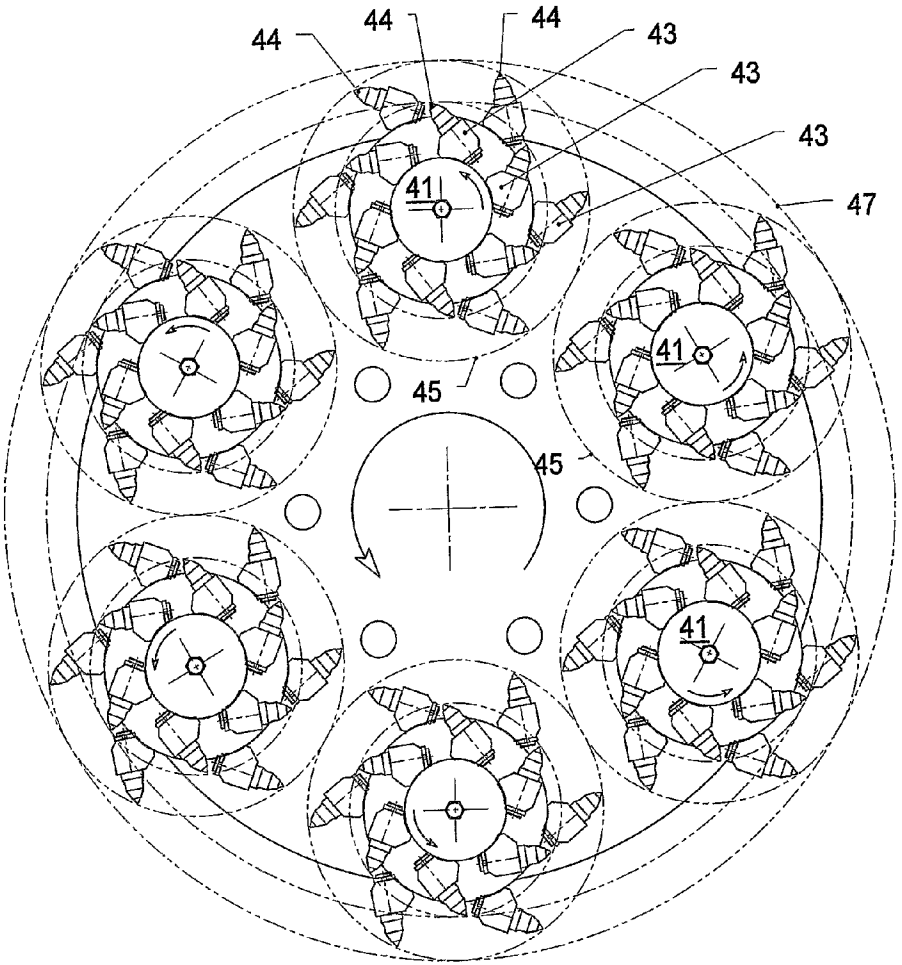
FIG. 3 (FIGS. 3A and 3B) shows a third embodiment of the device according to the invention in a representation corresponding to FIGS. 1 and 2.
Figure 3A:
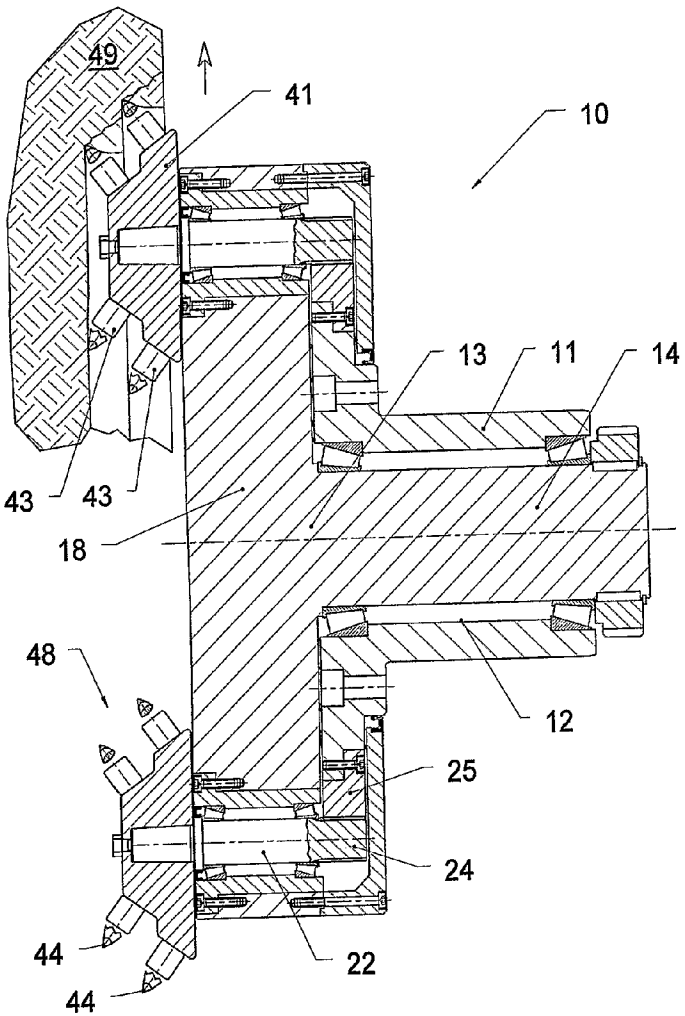

FIG. 3 shows the device according to FIG. 2, as provided with machining tools 41 in the form of conical, two-stage chisel milling cutters 48, which respectively comprise six individual tools 43 at axially successively arranged mounting circles. The chisel milling cutters mill through the rock 49 in two stages during the operation of the device, so that the radially external machining tools impact the rock 49 in a first sphere of activity 46*a* closer to the device, and the radially inner tools in a second sphere of activity 46*b* which establishes deeper in the rock. It can easily be seen that, by the overlapping of the rotation of the spindle drum 13 and the rotation of the tool spindle, the individual tools 43 are actually engaged with the rock only for a short time, whereby the wear of the tools is considerably reduced in a particularly advantageous manner compared to known cutting drums or the like. Instead of an arrangement in two stages, an arrangement in three or more stages can of course also be selected for the individual tools, in order to remove the rock or another material to be milled in one operation by a direction-free, lateral method of the device in an undercutting manner. An axial driving-in of the device into the rock is generally possible without any problem.

Figure 4B:
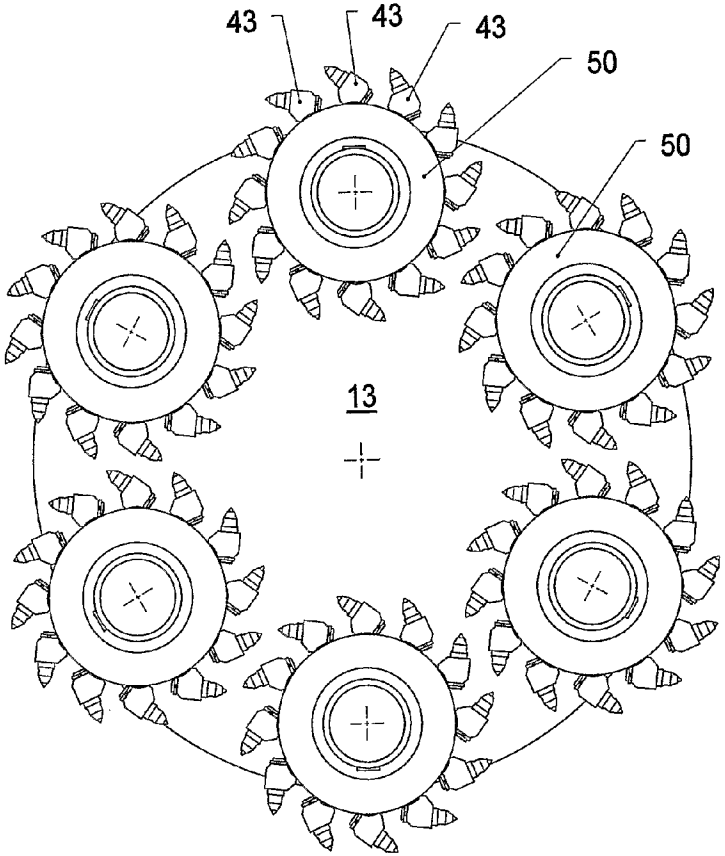
FIG. 4 (FIGS. 4A and 4B) shows a fourth embodiment of the device according to the invention in a representation corresponding to FIG. 1 to 3.
Figure 4A:
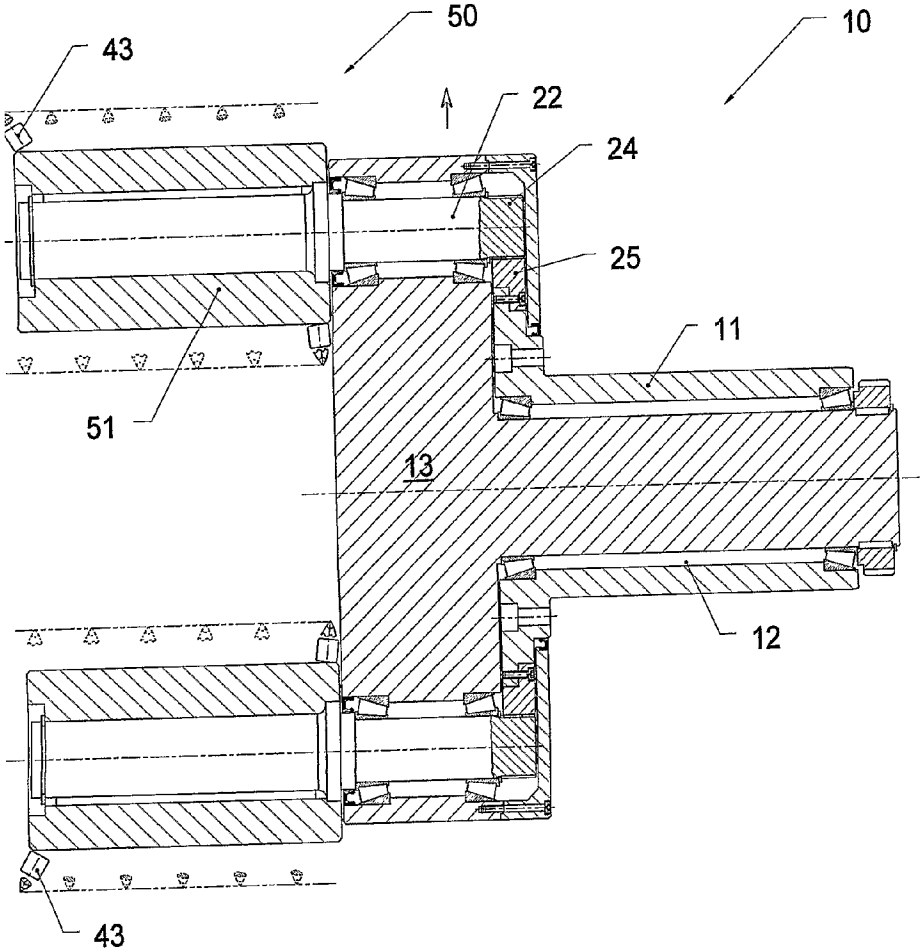

With embodiment shown in FIG. 4, the machining tools are end milling cutters 50, which comprise a support shaft 51 connected rigidly to the respective tool spindle 22, at the circumference of which are arranged individual tools 43, which can for example consist of straight shank chisels received in suitable tool holders. The individual tools are preferably arranged in a spiral form over the length of the support shaft 51 in this embodiment, while the arrangement can also take place in several spirals. With this arrangement, it is easily possible to drive axially into the material to be cut, and subsequently to remove the material in the entire driven depth or length of the shaft milling cutters by a direction-free, lateral method of the device. So as to ease the cutting, that is, the driving-in in the axial direction, it is possible to taper the diameter of the tools at least at their front region towards the face in the direction of the rock.

In FIG. 5, the preferred mode of operation which can be achieved with the device according to the invention can be seen in a particularly illustrative manner. While the spindle drum rotates with a first rotation speed in the direction of arrow A, for example with 50 rpm, the individual tool spindles rotate synchronously with a rotation speed corresponding to the chosen gear reduction, that is, with the embodiments of the device according to FIGS. 1, 3 and 4, in the same direction of rotation as the spindle drum. With an assumed gear transmission ratio of 1:10, the rotation speed of the tool spindles is thus 500 rpm. It can be seen that the first machining tool 41A, which impacts the rock 49 to be milled, impacts recesses 52 into the rock 49 with its four individual tools 43 with a certain rhythm or distance. The following machining tool 41B drives rock out between the recesses 52, whereby a wave profile 54 is formed in the rock at the approximately semicircular milling edge 53. The machining tools 41C and 41D following now successively remove the raised tips 55 in the wave profile, shown in a hatched representation, whereby the milling edge is smoothed as far as possible, and with the further feed of the spindle drum in the direction of the arrow 56, the described procedure with the machining tools 41E to 41H can repeat itself. Alternatively, the tools 41E-H can also even be used for a further smoothing of the milling edge 53 in the rock. On the other hand, it is also possible, depending on the chosen gear reduction ratio and number of the individual tools 43 at the machining tools, that a first machining tool, for example tool 41A, pre-cuts, and that the regions remaining between the recesses 52 are knocked off with the following tool, and that the tool following in the circumferential direction of the drum then again drives out new recesses 52 as the first tool and that the following tool mills the regions remaining therebetween. The representation according to FIG. 5 is selected as if the tools 41A-D drive approximately simultaneously into the rock 49 to be cut, which is normally not the case in practice. It has proven to be particularly advantageous in experiments, if the tools—in the shown case the machining tools 4IA-H—are constructed in such a manner, that, with the shown engagement of 180° (full cut) only one individual tool of all (five) effective machining tools is in engagement with the rock on the 180° region of the milling edge 53, as then the entire pressing force or feeding force exerted on the spindle drum by the device can be used by only one individual tool, and not, as was usual up to now, is distributed simultaneously on several bits. The machining tools are positioned and adjusted in the preferred form so that the tools following in each case do not drive exactly into the outline produced by the preceding tools at the rock, but in an offset manner.

A further embodiment of the device according to the invention is shown in FIG. 6. This embodiment is based on the device according to FIG. 1 and differs from this by the mounting of the drive gear wheel 25, at which the driven gear wheels 24 of the tool spindles roll off. In the embodiment according to FIG. 6, the drive gear wheel 25 is connected to the drum support 11 via an overload clutch 57, which effects a friction-locked connection between the drum support 11 and the drive gear wheel 25 via clutch linings 58. The activation moment where the overload clutch operates and the drive gear wheel begins to slip through with regard to the drum support can be adjusted. For this, an adjustment ring 59 can be engaged against the clutch package formed by the clutch linings and the intermediate part of the drive gear wheel 25 via a thread 60, in order to preload a plate spring 61 which then acts thereon with a constant spring load over the circumference of the clutch. With this arrangement, it is ensured that the device is not damaged when a tool driving into the rock blocks, as in such a case, the overload clutch responds and separates all machining tools from the common drive of the spindle drum and the tools until the blocking of the concerned individual tool ceases. The synchronisation of the individual machining tools with one another still remains, as these all stay in engagement with the driven gear wheel during the activation of the clutch.

The embodiment of the device according to the invention shown in FIG. 7 also uses the overload clutch, which is designed exactly as with the embodiment according to FIG. 7. In the embodiment shown in FIG. 7, however, there is selected a separate drive from the spindle drum drive for the tool spindles. For this, a drive ring 62 is mounted in a rotary manner at the drum support 11 at a front section 11*a*, which ring supports the drive gear wheel mounted via the overload clutch 57 at its outer circumference. The drive ring is provided with an internal gearing 63 at it axial rear region, into which gearing engages a drive pinion (not shown) of a common tool drive, so as to effect the rotation of the drive ring on the drum body 11, and to drive the tool spindles hereby.

FIG. 8 again shows the device according to FIG. 1, this time with machining tools in the form of cutting plates 64, which essentially consist of an approximately plate-shaped support 65 and respectively four cutting discs 66 arranged evenly over the circumference of the support 65, which discs are rotatably mounted in the support 65. The arrangement is such that the axes of rotation of the discs 66 do not run parallel to the axis of rotation of the support 65 mounted irrotationally on the associated tool spindle, but are inclined inwardly towards the rock, so that during the cut of the cutting discs into the rock 49 the faces of the cutting discs do not come into contact with the rock, but that it is ensured that the cutting discs 66 actually only machine the rock with their rotating cutting edge 67. By the rotary mounting of the cutting discs in the support of the cutting plates it is ensured that the cutting discs can roll off in the rock along their cutting edge at the generated milling edge 53. In a preferred further development of this embodiment, not shown, the individual cutting discs can be coupled to one another via a suitable coupling tool as for example a belt transmission or a gear wheel transmission present in the inside of the support, whereby it is ensured that, during the rotation of the tool spindle, an individual tool (cutting disc) coming into engagement with the rock already comprises the same circumferential speed, as a preceding individual tool leaving the engagement, so that a possible damage does not occur here by the sudden acceleration of the cutting disc during contact with the surrounding rock. The machining tools which are used in the embodiment according to FIG. 8 are particularly suitably for somewhat softer rocks to be machined, for example during the production of coal.

With the embodiment shown in FIG. 9, the spindle axes 68 of the tool spindles 22 are not aligned parallel to the drum axis 34 of the spindle drum 13, but are inclined inwardly in the direction of the rock. For this, the bearing bushes 21 are bored diagonally for the reception of the tool spindles mounted therein and the drive gear wheel 25 is a formed as a bevel gear, at which the driven gear wheels 24 of the diagonal tool spindles formed at the tool spindles roll off.

With the embodiment of the device according to the invention according to FIG. 10, the tool spindles 22 are arranged on two different pitch circles 19*a*, 19*b*, as can easily be seen in FIG. 10. The drive of the first group 69 of tool spindles on the first, outer pitch circle 19*a* and of the second group of 70 of tool spindles on the inner pitch circle 19*b* takes place through a common drive element in the form of a stepped drive gear wheel 25, which comprises a first gear ring of larger diameter 25*a* for the tool spindles of the first group lying outside and a second gear ring 25*b* with smaller diameter, which drives the tool spindles of the second group 70 which lie radially somewhat further inside. In all other respects, the structure of the embodiment according to FIG. 10 corresponds to the one used with FIG. 1.

With the embodiments of the device according to the invention described up to now with a common drive for the spindle drum and the tool spindles mounted rotatably therein, the direction of rotation of the spindle drum and the tool spindles was the same. FIG. 11 now shows an embodiment where the tool spindles rotate against the direction of rotation of the spindle drum 13. For this, the drive element for the tool spindles consists of a drive gear ring 71 geared on the inside, which is centrally fastened to the drum support 11 and in which engage the tool spindles with their driven gear wheels 24, as can be seen in the drawing.

With the embodiments shown in FIGS. 12 and 13, shaft milling cutters with a comparatively long support shaft 51 are used as machining tools 41, which cannot, due to the large axial length of the tools, be overhung alone like the embodiments shown so far. Accordingly, with the embodiments according to FIG. 12 and FIG. 13, the machining tools are mounted at the spindle drum with their respective tool spindles by means of a two-point mounting. The spindle drum comprises a plate-like bearing flange 18 in the proximity of the drum support 11 for the reception of the first bearings of the tool spindle for this, which form the fixed bearing for the two-point bearing with the shown embodiment and which is executed in the form of a mounted bearing in a back-to-back arrangement with cone roller bearings. The spindle drum further comprises a projecting support journal 72 arranged concentrically to the drum axis 34 which supports a support element 73 for the reception of the second bearings 74 of the machining tools arranged on the tool spindles near its free end. With embodiments according to FIG. 12 and FIG. 13, the second bearings at the support element form the floating bearing for the fixed floating bearing of the machining tools. They consist of cylinder roller bearings, which are particularly suitable for the reception of large radial forces. With the embodiment according to FIG. 12, the support element consists of a lid flange 75 arranged at the face of the support journal 72, which flange is provided with bearing receptions 76 for the cylinder roller bearings 74. This embodiment of the two-point bearing for the machining tools is particularly stable, but it is not suitable for an axial driving of the tools into the rock to be machined, as the machining tools are not effective at the face, by being covered by the lid flange 75. This disadvantage is avoided with the embodiment according to FIG. 13, where two support elements 73*a*, 73*b* are provided, which support respectively every second machining tool at the circumference of the spindle drum in a star-shaped manner. The two support elements 73*a*, 73*b* are arranged with different distances s, S from the bearing flange 18 for this, and support the respective second bearings of different tool spindles in star-shaped projecting arms 77. So that the spindle drum in the embodiment according to FIG. 12 or FIG. 13 cannot sag due to the forces acting on the machining tools, the lid flange 75 or the support journal 72 can be provided with a bearing journal 86 arranged concentrically to the spindle drum axis 34, shown with dash-dot lines in the drawings for the additional support of the spindle drum by means of a bearing (not shown), which is for example present in the same machine frame as the drum support at this opposite side.

Finally, with the embodiment shown in FIG. 14, the spindle drum 13 is, additionally to the tool spindles 22, which are distributed evenly over its circumference with milling tools 41 arranged thereon, provided with a core milling device 78 arranged on the inside of the pitch circle 19 described by the tool spindles, which milling device is arranged with a small eccentricity e to the drum axis 34, and which is driven opposite to the direction of rotation of the tool spindles. The core milling device thereby consists of a reception cartridge 79, on the inside of which is mounted a milling shaft 80 in a rotary manner, which carries a milling head 81 at its front end pointing towards the rock. At its rear end, which projects from the reception cartridge 79, the milling shaft is provided with a front gear wheel 82 which is flanged thereon. The reception cartridge 79 with the shaft mounted therein is inserted in a milling cutter reception provided at the bearing flange 18 of the spindle drum 13 and is irrotationally fixed. In the mounted condition, the front wheel 82 meshes with an internally geared milling cutter drive gear ring 83, which is firmly mounted to the drum support 11 and which engages in a circumferential groove 84 provided at the rear side of the bearing flange of the spindle drum. The core milling cutter is thereby driven in the opposite rotary direction to the direction of rotation of the spindle drum and favours in particular during the axial driving-in of the tool into the rock the excavation of the material possibly remaining in the central area 85 described by the tool spindles.

The invention is not limited to the shown and described examples of embodiments, but different changes and additions are feasible, without leaving the scope of the invention. It is for example possible to let the tool spindles of a first group of tools and the tool spindles of a second group of tools rotate in opposite directions, in particular when the tools of the first group are provided on a different pitch circle to those of the second group. The details shown and described on the basis of the individual embodiments can be combined with one another in most diverse ways, which can be noted by the expert without special difficulties. With the selection of suitable machining tools it is easily possible, to use the device according to the invention also for the machining of other materials than rock or coal, for example for the machining of metal, wood or plastics.

The invention claimed is:

1. A device for milling rock and other materials, the device comprising:

a drum support (11);

a spindle drum (13) rotatably mounted relative to the drum support (11) and rotatable about a drum axis (34), the spindle drum comprising:

several tool spindles (22) mounted for rotation about spindle axes (68) which are eccentric from the drum axis, said tool spindles carrying respective machining tools (41) at their ends projecting from the spindle drum (13); and, a common transmission gear drive (24, 25) for driving at least two of the tool spindles (22), the common transmission gear drive (24,25) comprising:

driven gear wheels (24) drivingly connected to the tool spindles (22); and, a common drive element (25) drivingly engaged with the driven gear wheels (24), the common transmission gear drive (24,25) being arranged such that the drive element (25) and the spindle drum (13) are rotatable relative to one another.

2. The device according to claim 1, wherein the spindle drum (13) comprises a rotary drive, which is decoupled from the transmission gear drive (24, 25).

3. The device according to claim 1, wherein the spindle drum (13) and at least one part of the tool spindles (22) have a common rotary drive.

4. The device according to claim 1, wherein the drive element (25) comprises a drive gear wheel.

5. The device according to claim 1, wherein the drive element (25) comprises at least one of a drive chain and a drive gear belt.

6. The device according to claim 4, wherein the drive gear wheel (25) is arranged irrotationally with respect to the drum support (11).

7. The device according to claim 6, wherein the drive gear wheel (25) is drivingly connected to the drum support (11).

8. The device according to claim 1, wherein the tool spindles (22) are rotatably received in bearing bushes (21) by means of bearings and in a sealing manner by means of shaft sealings.

9. The device according to claim 8, wherein the bearing bushes (21) with the tool spindles (22) mounted therein in a rotary manner are inserted and retained in drum chambers (20) provided at the spindle drum (13) in an exchangeable manner as a cartridge.

10. The device according to claim 4, wherein all tool spindles (22) can be driven via the common drive gear wheel (25) of the transmission gear drive.

11. The device according to claim 1, wherein the drive element (25) comprises a first common drive gear wheel (25*a*) and a second common drive gear wheel (25*b*), and wherein a first group (69) of tool spindles (22) can be driven via a first common drive gearwheel (25*a*) and a second group (70) of tool spindles (22) via a second common drive gear wheel (25*b*).

12. The device according to claim 11, wherein the gear transmission ratios between the tool spindles (22) of the first group (69) and the first drive gear wheel (25*a*) and the tool spindles of the second group (70) and the second drive gearwheel (25*b*) and/or the directions of rotation of the tool spindles of the first and second group are different.

13. The device according to claim 11 wherein the tool spindles (22) of the first group (69) and of the second group (70) are arranged with a different radial distance from the drum axis (34) in the spindle drum (13).

14. The device according to claim 1, wherein the tool spindles (22) are arranged over a circumference in the spindle drum (13) in an evenly distributed manner.

15. A device for milling rock and other materials, the device comprising:

a drum support (11);

a spindle drum (13) rotatably mounted relative to the drum support (11) and rotatable about a drum axis (34), the spindle drum comprising:

several tool spindles (22) mounted for rotation about spindle axes (68) which are eccentric from the drum axis, said tool spindles carrying respective machining tools (41) at their ends projecting from the spindle drum (13); and, a common transmission gear drive (24, 25) for driving at least two of the tool spindles (22), the common transmission gear drive (24,25) comprising:

driven gear wheels (24) drivingly connected to the tool spindles (22); and, a common drive element (25) drivingly engaged with the driven gear wheels (24), the common transmission gear drive (24,25) being arranged such that the drive element (25) and the spindle drum (13) are rotatable relative to one another;

wherein the tool spindles (22) are arranged over a circumference in the spindle drum (13) in an evenly distributed manner; and, wherein the machining tool(s) (41A) arranged at a tool spindle (22) is/are arranged offset with an angular amount relative to the arrangement of the machining tool(s) (41) of a tool spindle (41H, 41B) lying in front or behind thereof in the circumference direction of the drum.

16. The device according to claim 1, wherein the relative position of the machining tools (41) to their respective tool spindles (22) is the same.

17. The device according to claim 1, wherein the machining tools (41) are arranged at the tool spindles (22) in an adjustable manner.

18. The device according to claim 1, wherein the machining tools (41) comprise one or several individual tools (43) at each tool spindle (22).

19. The device according to claim 18, wherein the individual tools (43) comprise round bits, flat bits or roller bits which are conically chamfered on one side.

20. The device according to claim 1, wherein the machining tools (41) project radially over a circumference (46) of the spindle drum (13) at the most with 50% of their circumferential machining surfaces (44).

21. The device according to claim 19 wherein at the most half of all machining chisels (41) of a tool spindle (22) project simultaneously radially over the outer circumference (46) of the spindle drum (13).

22. The device according to claim 1, wherein the tool spindles (22) are arranged on several concentric pitch circles (19*a, b*) in the spindle drum (22).

23. The device according to claim 1, wherein the spindle drum (22) is provided with a preferably centrically arranged dust extractor opening.

24. The device according to claim 1 further comprising a spraying device for the machining tools.

25. The device according to claim 24, wherein the spraying device is arranged at the spindle drum (13) and/or at the drum support (11).

26. The device according to claim 1, wherein the machining tools (41) of one or several of the tool spindles (22) comprise a chisel/bit support (42; 65) and several round bits, flat bits and/or roller bits arranged thereon, wherein the chisel tools (43) arranged on the chisel support are adapted to machine rock or another material in an undercut manner in one or several layers.

27. The device according to claim 26, wherein several roller bits or rotary cutters (66) are mounted in a rotary manner on a common support (65) which is flanged to the associated tool spindle (22), and wherein the roller bits or rotary cutters (66) mounted at a common support are coupled in a rotary manner according to the operation.

28. The device according to claim 1, wherein the machining tools (41) of one or several of the tool spindles (22) comprise milling rollers.

29. The device according to claim 28, wherein the milling rollers are cylindrical or taper conically or expand towards the rock (49) or like material to be machined.

30. The device according to claim 1, wherein the drive element (25) comprises a drive gear wheel which is geared on the outside.

31. The device according to claim 1, wherein the drive element comprises a drive gear ring (62), which is geared on the inside.

32. The device according to claim 1, wherein the machining tools (41) of tool spindles (22) following each other in the circumferential direction of the spindle drum (13) are arranged in a phase-shift manner with regard to one another.

33. The device according to claim 1, wherein the spindle drum (13) comprises a reception bore (35) running coaxially to the drum axis (34) for a drive shaft (36) which is mounted in a rotary manner in the reception bore and which is coupled to the drive element (25) for the tool spindles (22).

34. The device according to claim 33, wherein the spindle drum (13) comprises a closed housing (31) with an approximately cup-shaped drum base (38) and a housing lid (30), whereas the drive element (25) is received on the inside of the drum base (38) and is connected to the drive shaft (36) and is covered by the housing lid (30).

35. The device according to claim 1, wherein the gear drive (24, 25) for the tool spindles (22) is arranged in the spindle drum (13) in a sealed manner.

36. The device according to claim 1, wherein the machining tools (41) are mounted at the spindle drum (13) in an overhung position with their respective tool spindles (22).

37. The device according to claim 1, wherein the spindle drum (13) is provided with a core milling device (78) arranged in the inside of the pitch circle (19) described by the tool spindles (22) additionally to the tool spindles (22) arranged in a distributed manner over the circumference with machining tools (41), which milling device is preferably arranged with low eccentricity (e) with regard to the drum axis (34).

38. The device according to claim 37, wherein the core milling device can be driven or is driven.

39. The device according to claim 1, wherein the machining tools (41) are mounted at the spindle drum (13) with their respective tool spindles (22) via two spaced bearings.

40. The device according to claim 39, wherein the two spaced bearing comprise one fixed bearing and one floating bearing.

41. The device according to claim 39, wherein the two spaced bearings are adjusted bearings in particular in a back-to-back arrangement.

42. The device according to claim 39, wherein the spindle drum (13) comprises an approximately plate-like bearing flange (18) in the proximity of the drum support (11) for the reception of the first bearings of the tool spindles (22) and a support journal (72) projecting concentrically from the drum axis (34), where is arranged at least one support element (73) for the reception of the second bearings (74) of the machining tools.

43. The device according to claim 42, wherein the support element (73) or the support journal (72) comprises a bearing journal (86) arranged concentrically to the spindle drum axis (34) for the additional support of the spindle drum (13).

44. The device according to claim 42 wherein the support element (73) comprises a lid flange (75) arranged at the face of the support journal (72), which flange is provided with bearing receptions (76) for the second bearings (74).

45. The device according to claim 42 wherein at least two support elements (73*a,b*) are provided which are arranged with different distances (S,s) from the bearing flange and which respectively receive the second bearings (74) from different tool spindles (22).

46. The device according to claim 1, wherein the drive element (25) is connected to the drum support (11) via an overload clutch (57).

47. The device according to claim 46, wherein the overload clutch (57) is spring-loaded and that the spring load can be adjusted with regard to the clutch.

48. The device according to claim 1, wherein the spindle drum (13) is provided with a demountable sealing cap (30) sealed by means of a shaft seal (32) with regard to the drum support (11) on its rear side facing away from the machining tools (41).

49. The device according to claim 1, wherein the tool spindle axes (68) are arranged in an inclined manner relative to the drum axis (34).

50. The device according to claim 1, wherein every machining tool (41) comprises several individual tools (43) distributed evenly over the circumference of the machining tool and is mounted using a detent coupling at the associated tool spindles, whereby the number of possible lock positions of the detent coupling is adapted to the number of the individual tools arranged at the machining tool in such a manner that these are in the same relative position to the tool spindle in every locked position.

51. A method for milling rock or the like, said method comprising:

providing a device for milling rock and other materials, the device comprising a drum support (11) and a spindle drum (13) rotatably mounted relative to the drum support (11) and rotatable about a drum axis (34), the spindle drum comprising: (i) several tool spindles (22) are pivotally-mounted about spindle axes (68) which are eccentric from the drum axis, said tool spindles carrying machining tools (41) at their ends projecting from the spindle drum (13); and, (ii) a common transmission gear drive (24, 25) for driving at least two of the tool spindles (22), the common transmission gear drive (24,25) comprising: (a) driven gear wheels (24) drivingly connected to the tool spindles (22); and, (b) a common drive element (25) drivingly engaged with the driven gear wheels (24), the common transmission gear drive (24,25) being arranged such that the drive element (25) and the spindle drum (13) are rotatable relative to one another; and, adjusting the rotary speed of the tool spindles (22) and the rotary speed of the spindle drum (13) and/or the angular position of the individual tools (43) arranged at the individual tool spindles (22) relative to the angular position of the individual tools (43) of the tool spindles lying in front or behind thereof in the circumferential direction so that an individual tool (43) of a following tool spindle (22) does not impact the rock or the like at the same point of impact as an individual tool (43) of a preceding workpiece spindle.

52. The method according to claim 51, wherein an individual tool (43) of a following spindle impacts the rock or the like between points of impact (52) of the individual tools (43) of a preceding spindle.

53. The method according to claim 51 wherein as few as possible individual tools (43) are simultaneously in a milling engagement with the rock or the like to be milled.

54. The method of claim 51, wherein said method comprises at least one of: (i) mining of mineral extraction products such as coal, ore rock or the like; or (ii) machining of concreted or tarmacked surfaces or buildings.

* * * * *